US007069629B2

(12) United States Patent
Burgess et al.

(10) Patent No.: US 7,069,629 B2
(45) Date of Patent: Jul. 4, 2006

(54) DURABLE LIGHTWEIGHT IMAGED NONWOVEN WIPE

(75) Inventors: Brian Burgess, Benton, AR (US); Benjamin Nolan, Elmer, NJ (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 11/013,009

(22) Filed: Dec. 15, 2004

(65) Prior Publication Data

US 2005/0144766 A1 Jul. 7, 2005

Related U.S. Application Data

(60) Provisional application No. 60/529,685, filed on Dec. 15, 2003.

(51) Int. Cl.
*D04H 1/46* (2006.01)

(52) U.S. Cl. ..... 28/104; 28/167

(58) Field of Classification Search ..... 28/104, 28/105, 106, 103, 107, 112, 167, 165, 101, 28/102; 156/148; 442/408, 384, 387, 409
See application file for complete search history.

(56) References Cited

U.S. PATENT DOCUMENTS 3,485,706 A 12/1969 Evans
3,929,678 A 12/1975 Laughlin et al.
5,043,155 A 8/1991 Puchalski et al.
5,108,642 A 4/1992 Aszman et al.
5,475,903 A * 12/1995 Collins ..... 28/104
5,534,265 A 7/1996 Fowler et al.
5,573,841 A * 11/1996 Adam et al. ..... 428/219
5,648,083 A 7/1997 Blieszner et al.
6,103,683 A 8/2000 Romano et al.
6,340,663 B1 1/2002 Delco et al.
6,534,472 B1 3/2003 Arvanitidou et al.
6,539,596 B1 * 4/2003 Hwo et al. ..... 28/104
6,753,063 B1 * 6/2004 Pung et al. ..... 428/152
2002/0007540 A1 * 1/2002 Black et al. ..... 28/105
2002/0146957 A1 * 10/2002 Fuller et al. ..... 442/409
2002/0160676 A1 * 10/2002 Putnam et al. ..... 442/105
2003/0143912 A1 * 7/2003 Black et al. ..... 442/327
2004/0068849 A1 * 4/2004 Barge et al. ..... 28/104

* cited by examiner

*Primary Examiner*—Amy B. Vanatta
(74) *Attorney, Agent, or Firm*—Wood, Phillips, Katz, Clark & Mortimer

(57) ABSTRACT

The present invention is directed to a nonwoven fabric, and specifically to a durable lightweight nonwoven fabric wipe, comprising improved strength, as well as an improved MD to CD elongation ratio, which results in a material imminently suitable for application in the cleaning and cleansing of surfaces. A method of making the nonwoven fabric embodying the present invention includes the steps of providing a precursor web comprising a fibrous matrix. The method further comprises the steps of providing a precursor web, which is subjected to hydroentangling.

2 Claims, 1 Drawing Sheet

DURABLE LIGHTWEIGHT IMAGED NONWOVEN WIPE

TECHNICAL FIELD

The present invention relates generally to a nonwoven fabric, and specifically to a durable lightweight nonwoven fabric wipe, comprising improved strength, as well as an improved MD to CD elongation ratio, which results in a material imminently suitable for application in the cleaning and cleansing of surfaces.

BACKGROUND OF THE INVENTION

The production of conventional textile fabrics is known to be a complex, multi-step process. The production of fabrics from staple fibers begins with the carding process where the fibers are opened and aligned into a feed stock known as sliver. Several strands of sliver are then drawn multiple times on a drawing frames to further align the fibers, blend, improve uniformity as well as reduce the slivers diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes as the fabrics are produced directly from the carding process. Nonwoven fabrics are suitable for use in a wide variety of applications where the efficiency with which the fabrics can be manufactured provides a significant economic advantage for these fabrics versus traditional textiles.

Various cleaning products, and specifically personal or baby wipes, are commercially available which utilize one or more layers of carded nonwoven fabrics within the construct of the wipe. Nonwoven carded webs tend to be lightweight and lacking integrity, exhibiting a poor CD elongation performance. In order to make thicker webs, multiple cards, or transverse folding of the web, also called cross-lapping can be used. As will be recognized by those familiar with the art, a precursor web formed by "100% in-line card" refers to a web formed entirely from carded fibers, wherein all of the fibers are principally oriented in the machine direction of the web. A precursor web formed by "all cross-lap" refers to a fibrous web wherein the fibers or filaments have been formed by cross-lapping a carded web so that the fibers or filaments are oriented at an angle relative to the machine direction of the resultant web. Cross-lapping a carded web enhances the overall strength of the web, as well as decreases web elongation; however cross-lapping a carded web also decreases the process speed of the resulting nonwoven fabric.

A need remains for a lightweight, yet durable carded wipe material that can be manufactured at faster production speeds, as well as exhibits improved MD to CD strength and elongation ratios.

SUMMARY OF THE INVENTION

The present invention is directed to a nonwoven fabric, and specifically to a durable lightweight nonwoven fabric wipe, comprising improved strength, as well as an improved MD to CD elongation ratio, which results in a material imminently suitable for application in the cleaning and cleansing of surfaces.

In accordance with the present invention, a method of making the nonwoven fabric embodying the present invention includes the steps of providing a precursor web comprising a fibrous matrix. The fibrous matrix is composed of a blend of staple length fibers, which are carded and cross-lapped once to form a precursor web. The cross-lapper front apron speed is directly related to the line speed and the number of folds the cross-lapper imparts into the carded web. Manufacturing the lightweight nonwoven fabric wipe by setting the cross-lappers to impart one fold into the web effectively increases the production speed. As a result, a lightweight yet durable nonwoven fabric is able to be produced at a lower cost.

A method of making the durable, yet lightweight nonwoven fabric wipe further comprises the steps of providing a precursor web, which is subjected to hydroentangling. U.S. Pat. No. 3,485,706, to Evans, hereby incorporated by reference, discloses processes for effecting hydroentanglement of nonwoven fabrics. More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, hereby incorporated by reference, with the use of such image transfer devices being desirable for providing a fabric with enhanced physical properties as well as having a pleasing appearance.

The precursor web is formed into an imaged and patterned nonwoven fabric by hydroentanglement on a foraminous surface, including, but not limited to a three-dimensional image transfer device, embossed screen, three-dimensionally surfaced belt, or perforated drum. In a preferred embodiment, a three-dimensional transfer device defines three-dimensional elements against which the precursor web is forced during hydroentangling, whereby the fibrous constituents of the web are imaged and patterned by movement into regions between the three-dimensional elements of the transfer device. Further, the precursor web is preferably hydroentangled on a foraminous surface prior to hydroentangling on the image transfer device. This pre-entangling of the precursor web acts to integrate the fibrous components of the web, but does not impart imaging and patterning as can be achieved through the use of the three-dimensional image transfer device or the like.

Manufacture of a lightweight wipe embodying the principles of the present invention is initiated by providing a batt or layer of fibrous components. The fibrous batt can be comprised of finite-length staple fibers or essentially continuous filaments selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for use include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 8 inches, the range of 1 to 3 inches being preferred and the fiber denier selected in the range of 1 to 15, the range of 2 to 6 denier being preferred for general applications. The profile of the fiber is not a limitation to the applicability of the present invention.

Other features and advantages of the present invention will become readily apparent from the following detailed description, the accompanying drawings, and the appended claims.

DETAILED DESCRIPTION

Figure 1:
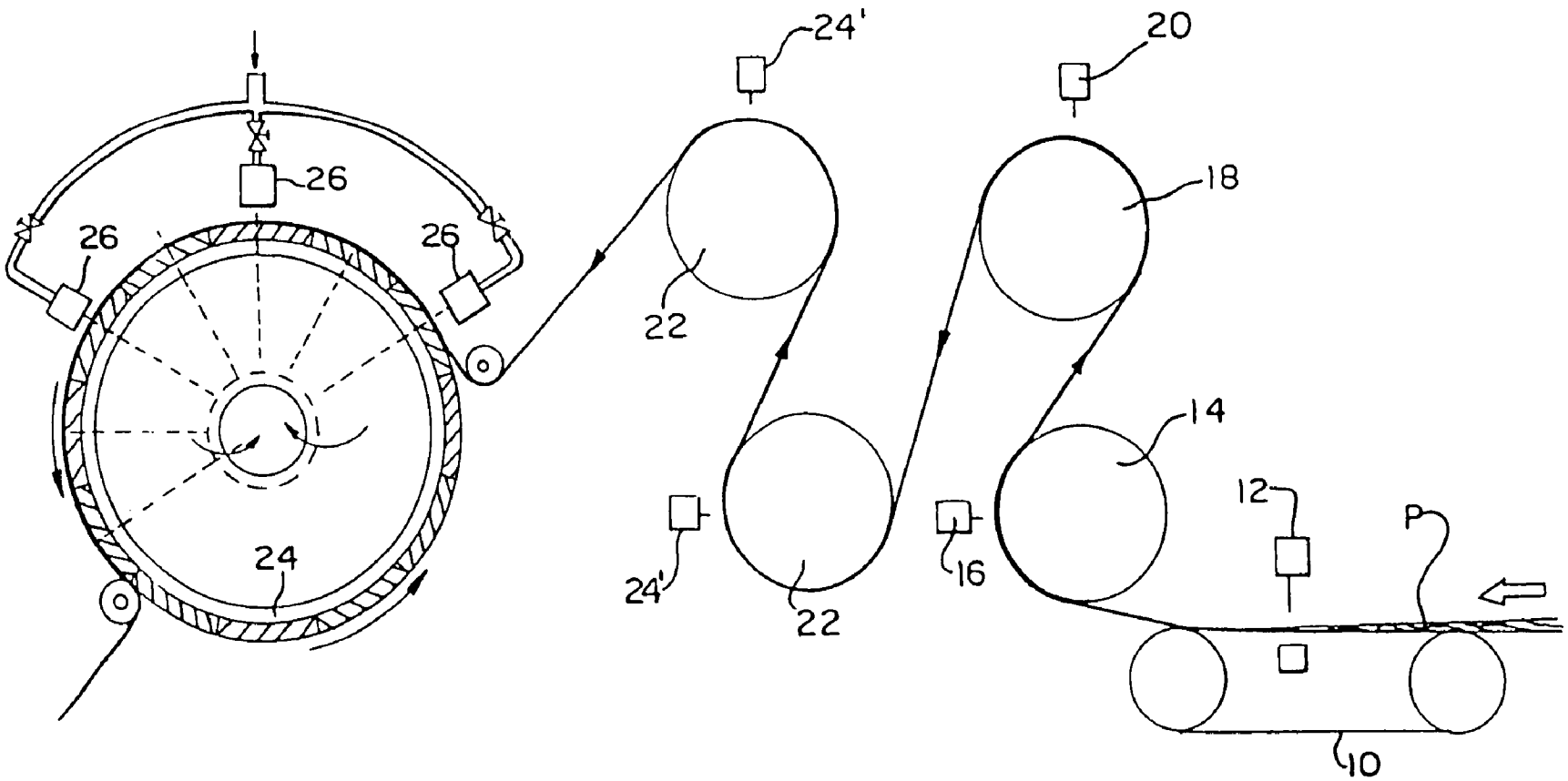
FIG. 1 is a diagrammatic view of an apparatus for manufacturing a nonwoven fabric, embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

With reference to FIG. 1, therein is illustrated an apparatus for practicing the present method for forming a nonwoven fabric. The lightweight nonwoven fabric wipe is formed from a fibrous matrix which typically comprises staple length fibers. The fibrous matrix is preferably carded and cross-lapped to impart a single transverse fold into the precursor web, designated P. Limiting the number of imparted folds to one, allows for a lightweight, yet durable wipe to be produced in an in-line process at increased speeds of at least 150 meters per minute. In a current embodiment, the precursor web comprises 100% cross-lap fibers, that is, all of the fibers of the web have been formed by cross-lapping a carded web so that the fibers are oriented at an angle relative to the machine direction of the resultant web.

FIG. 1 illustrates a hydroentangling apparatus for forming nonwoven fabrics in accordance with the present invention. The apparatus includes a foraminous forming surface in the form of belt 10 upon which the precursor web P is positioned for pre-entangling by entangling manifold 12. Pre-entangling of the precursor web, prior to imaging and patterning, is subsequently effected by movement of the web P sequentially over a drum 14 having a foraminous forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24', 24'.

The entangling apparatus of FIG. 1 further includes an imaging and patterning drum 24 comprising a three-dimensional image transfer device for effecting imaging and patterning of the now-entangled precursor web. Optionally, the entangling apparatus may include a CPN belt, perforated drum, or any other foraminous surface in place of the three-dimensional image transfer device. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

Subsequent to entanglement, fabric integrity can be further enhanced by the optional application of a binder and/or by thermal stabilization of the entangled fibrous matrix. A binder composition that can be either incorporated as a fusible fiber in the formation of the precursor nonwoven web or as a liquid fiber adhesive applied after imaged fabric formation. The binder material can further improve the durability or otherwise provide enhanced cleaning performance of the resultant imaged nonwoven fabric during use.

In accordance with the present invention, the lightweight nonwoven wipe has a basis weight equal to or less than 2.0 ounces per square yard with an improved CD to MD ratio. Preferably, the wipe has a CD to MD ratio of 3:1, more preferably 2:1, and most preferably 1.5:1. The wipe may comprise finite-length staple fibers or essentially continuous filaments selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for use include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 8 inches, the range of 1 to 3 inches being preferred and the fiber denier selected in the range of 1 to 15, the range of 2 to 6 denier being preferred for general applications. The profile of the fiber is not a limitation to the applicability of the present invention.

In accordance with the present invention, the nonwoven lightweight nonwoven wipe includes the use of various aqueous and non-aqueous compositions. The nonwoven wipe may be used in various personal and home care applications, wherein the end use article may be a dry or wet hand held sheet, such as a wipe, a mitt formation, or a cleaning implement capable of retaining the article.

Cleansing compositions suitable for such end use applications include those that are described in U.S. Pat. No. 6,103,683 to Romano, et al., U.S. Pat. No. 6,340,663 to Deleo, et al., U.S. Pat. No. 5,108,642 to Aszman, et al., and U.S. Pat. No. 6,534,472 Arvanitidou, et al., all of which are hereby incorporated by reference. Selected cleaning compositions may also include surfactants, such as alkylpolysaccharides, alkyl ethoxylates, alkyl sulfonates, and mixtures thereof; organic solvent, mono- or polycarboxylic acids, odor control agents, such as cyclodextrin, peroxides, such as benzoyl peroxide, hydrogen peroxide, and mixtures thereof, thickening polymers, aqueous solvent systems, suds suppressors, perfumes or fragrances, and detergent adjuvants, such as detergency builder, buffer, preservative, antibacterial agent, colorant, bleaching agents, chelants, enzymes, hydrotropes, and mixtures thereof. The aforementioned compositions preferably comprise from about 50% to about 500%, preferably from about 200% to about 400% by weight of the nonwoven lightweight wipe.

The lightweight wipe embodying the principles of the present invention is also suitable for personal cleaning or cleansing wipes. Non-limiting examples of such applications include dry or wet facial wipes, body wipes, and baby wipes. Suitable methods for the application of various aqueous and non-aqueous compositions comprise aqueous/alcoholic impregnates, including flood coating, spray coating or metered dosing. Further, more specialized techniques, such as Meyer Rod, floating knife or doctor blade, which are typically used to impregnate cleansing solutions into absorbent sheets, may also be used. The following compositions preferably comprise from about 50% to about 500%, preferably from about 200% to about 400% by weight of the nonwoven lightweight wipe.

The lightweight wipe may incorporate a functional additive, such as an alpha-hydroxycarboxylic acid, which refers not only the acid form but also salts thereof. Typical cationic counterions to form the salt are the alkali metals, alkaline earth metals, ammonium, $C_2$–$C_8$ trialkanolammonium cation and mixtures thereof. The term "alpha-hydroxycarboxylic acids" include not only hydroxyacids but also alpha-ketoacids and related compounds of polymeric forms of hydroxyacid.

Amounts of the alpha-hydroxycarboxylic acids may range from about 0.01 to about 20%, preferably from about 0.1 to about 15%, more preferably from about 1 to about 10%, optimally from about 3 to about 8% by weight of the composition which impregnates the substrate. The amount of impregnating composition relative to the substrate may range from about 20:1 to 1:20, preferably from 10:1 to about 1:10 and optimally from about 2:1 to about 1:2 by weight.

Further, a humectant may be incorporated with the aforementioned alpha-hydroxycarboxylic compositions. Humectants are normally polyols. Representative polyols include glycerin, diglycerin, polyalkylene glycols and more preferably alkylene polyols and their derivatives. Amounts of the polyol may range from about 0.5 to about 95%, preferably from about 1 to about 50%, more preferably from about 1.5 to 20%, optimally from about 3 to about 10% by weight of the impregnating composition.

A variety of cosmetically acceptable carrier vehicles may be employed although the carrier vehicle normally will be water. Amounts of the carrier vehicle may range from about 0.5 to about 99%, preferably from about 1 to about 80%, more preferably from about 50 to about 70%, optimally from about 65 to 75% by weight of the impregnating composition.

Preservatives can desirably be incorporated protect against the growth of potentially harmful microorganisms. Suitable traditional preservatives for compositions of this invention are alkyl esters of para-hydroxybenzoic acid. Other preservatives which have more recently come into use include hydantoin derivatives, propionate salts, and a variety of quatenary ammonium compounds. Preservatives are preferably employed in amounts ranging from 0.01% to 2% by weight of the composition.

The cosmetic composition may further include herbal extracts. Illustrative extracts include Roman Chamomile, Green Tea, Scullcap, Nettle Root, Swertia laponica, Fennel and Aloe Vera extracts. Amount of each of the extracts may range from about 0.001 to about 1%, preferably from about 0.01 to about 0.5%, optimally from about 0.05 to about 0.2% by weight of a composition.

Additional functional cosmetic additives may also include vitamins such as Vitamin E Acetate, Vitamin C, Vitamin A Palmitate, Panthenol and any of the Vitamin B complexes. Anti-irritant agents may also be present including those of steviosides, alpha-bisabolol and glycyhrizzinate salts, each vitamin or anti-irritant agent being present in amounts ranging from about 0.001 to about 1.0%, preferably from about 0.01 to about 0.3% by weight of the composition.

These impregnating compositions of the present invention may involve a range of pH although it is preferred to have a relatively low pH, for instance, a pH from about 2 to about 6.5, preferably from about 2.5 to about 4.5.

In addition to cosmetic compositions, lotions may be incorporated into the nonwoven lightweight wipe. The lotion preferably also comprises one or more of the following: an effective amount of a preservative, an effective amount of a humectant, an effective amount of an emollient; an effective amount of a fragrance, and an effective amount of a fragrance solubilizer.

As used herein, an emollient is a material that softens, soothes, supples, coats, lubricates, or moisturizes the skin. The term emollient includes, but is not limited to, conventional lipid materials (e.g. fats, waxes), polar lipids (lipids that have been hydrophylically modified to render them more water soluble), silicones, hydrocarbons, and other solvent materials. Emollients useful in the present invention can be petroleum based, fatty acid ester type, alkyl ethoxylate type, fatty acid ester ethoxylates, fatty alcohol type, polysiloxane type, mucopolysaccharides, or mixtures thereof.

Humectants are hygroscopic materials that function to draw water into the stratum comeum to hydrate the skin. The water may come from the dermis or from the atmosphere. Examples of humectants include glycerin, propylene glycol, and phospholipids.

Fragrance components, such as perfumes, include, but are not limited to water insoluble oils, including essential oils. Fragrance solubilizers are components which reduce the tendency of the water insoluble fragrance component to precipitate from the lotion. Examples of fragrance solubilizers include alcohols such as ethanol, isopropanol, benzyl alcohol, and phenoxyethanol; any high HLB (HLB greater than 13) emulsifier, including but not limited to polysorbate; and highly ethoxylated acids and alcohols.

Preservatives prevent the growth of micro-organisms in the liquid lotion and/or the substrate. Generally, such preservatives are hydrophobic or hydrophilic organic molecules. Suitable preservatives include, but are not limited to parabens, such as methyl parabens, propyl parabens, and combinations thereof.

The lotion can also comprise an effective amount of a kerotolytic for providing the function of encouraging healing of the skin. An especially preferred kerotolytic is Allantoin ((2,5-Dioxo-4-Imidazolidinyl)Urea), a heterocyclic organic compound having an empirical formula $C_4H_6N_4O_3$. Allantoin is commercially available from Tri-K Industries of Emerson, N.J. It is generally known that hyperhydrated skin is more susceptible to skin disorders, including heat rash, abrasion, pressure marks and skin barrier loss. A premoistened wipe according to the present invention can include an effective amount of allantoin for encouraging the healing of skin, such as skin which is over hydrated.

U.S. Pat. No. 5,534,265 issued Jul. 9, 1996; U.S. Pat. No. 5,043,155 issued Aug. 27, 1991; and U.S. Pat. No. 5,648,083 issued Jul. 15, 1997 are incorporated herein by reference for the purpose of disclosing additional lotion ingredients.

The lotion can further comprise between about 0.1 and about 3 percent by eight Allantoin, and about 0.1 to about 10 percent by weight of an aloe extract, such as aloe vera, which can serve as an emollient. Aloe vera extract is available in the form of a concentrated powder from the Rita Corporation of Woodstock, Ill.

Further, latherants may be incorporated within the lightweight wipe. Non-limiting examples of anionic lathering surfactants useful in the compositions of the present invention are disclosed in McCutcheon's, Detergents and Emulsifiers, North American edition (1986), published by allured Publishing Corporation; McCutcheon's, Functional Materials, North American Edition (1992); and U.S. Pat. No. 3,929,678, to Laughlin et al., issued Dec. 30, 1975, all of which are incorporated by reference herein in their entirety. A wide variety of anionic lathering surfactants are useful herein. Non-limiting examples of anionic lathering surfactants include those selected from the group consisting of sarcosinates, sulfates, isethionates, taurates, phosphates, lactylates, glutamates, and mixtures thereof.

Non-limiting examples of nonionic lathering surfactants and amphoteric surfactants for use in the compositions of the present invention are disclosed in McCutcheon's, Detergents and Emulsifiers, North American edition (1986), published by allured Publishing Corporation; and McCutcheon's, Functional Materials, North American Edition (1992); both of which are incorporated by reference herein in their entirety.

Nonionic lathering surfactants useful herein include those selected from the group consisting of alkyl glucosides, alkyl polyglucosides, polyhydroxy fatty acid amides, alkoxylated fatty acid esters, lathering sucrose esters, amine oxides, and mixtures thereof. The term "amphoteric lathering surfactant," as used herein, is also intended to encompass zwitterionic surfactants, which are well known to formulators skilled in the art as a subset of amphoteric surfactants.

A wide variety of amphoteric lathering surfactants can be used in the compositions of the present invention. Particularly useful are those which are broadly described as derivatives of aliphatic secondary and tertiary amines, preferably wherein the nitrogen is in a cationic state, in which the aliphatic radicals can be straight or branched chain and wherein one of the radicals contains an ionizable water solubilizing group, e.g., carboxy, sulfonate, sulfate, phosphate, or phosphonate. Nonlimiting examples of amphoteric or zwitterionic surfactants are those selected from the group consisting of betaines, sultaines, hydroxysultaines, alkyliminoacetates, iminodialkanoates, aminoalkanoates, and mixtures thereof.

Additional compositions utilized in accordance with the present invention can comprise a wide range of optional ingredients. The CTFA International Cosmetic ingredient Dictionary, Sixth Edition, 1995, which is incorporated by reference herein in its entirety, describes a wide variety of nonlimiting cosmetic and pharmaceutical ingredients commonly used in the skin care industry, which are suitable for use in the compositions of the present invention. Nonlimiting examples of functional classes of ingredients are described at page 537 of this reference. Examples of these functional classes include: abrasives, anti-acne agents, anticaking agents, antioxidants, binders, biological additives, bulking agents, chelating agents, chemical additives, natural additives, colorants, cosmetic astringents, cosmetic biocides, degreasers, denaturants, drug astringents, emulsifiers, external analgesics, film formers, fragrance components, humectants, opacifying agents, plasticizers, preservatives, propellants, reducing agents, skin bleaching agents, skin-conditioning agents (emollient, humectants, miscellaneous, and occlusive), skin protectants, solvents, foam boosters, hydrotropes, solubilizing agents, suspending agents (non-surfactant), sunscreen agents, ultraviolet light absorbers, and viscosity increasing agents (aqueous and nonaqueous). Examples of other functional classes of materials useful herein that are well known to one of ordinary skill in the art include solubilizing agents, sequestrants, and keratolytics, and the like.

The aforementioned classes of ingredients are incorporated in a safe and effective amount. The term "safe and effective amount" as used herein, means an amount of an active ingredient high enough to modify the condition to be treated or to deliver the desired skin benefit, but low enough to avoid serious side effects, at a reasonable benefit to risk ratio within the scope of sound medical judgment.

In addition to home care and personal care end uses, the nonwoven lightweight wipe may be used in industrial and medical applications. For instance, the article may be useful in paint preparation and cleaning outdoor surfaces, such as lawn furniture, grills, and outdoor equipment, wherein the low Tinting attributes of the laminate may be desirable. Aqueous or non-aqueous functional industrial solvents include, oils, such as plant oils, animal oils, terpenoids, silicon oils, mineral oils, white mineral oils, paraffinic solvents, polybutylenes, polyisobutylenes, polyalphaolefins, and mixtures thereof, toluenes, sequestering agents, corrosion inhibitors, abrasives, petroleum distillates, and the combinations thereof.

A medical lightweight wipe may incorporate an antimicrobial composition, including, but not limited to iodines, alcohols, such as such as ethanol or propanol, biocides, abrasives, metallic materials, such as metal oxide, metal salt, metal complex, metal alloy or mixtures thereof, bacteriostatic complexes, bactericidal complexs, and the combinations thereof.

The lightweight wipe of the present invention is particularly suitable for dispensing from a tub of stacked, folded wipes, or for dispensing as "pop-up" wipes, in which the lightweight wipe is stored in the tub as a perforated continuous roll, wherein upon pulling a wipe out of the tub, an edge of the next wipe is presented for easy dispensing. The wipes of the present invention can be folded in any of various known folding patterns, such as C-folding, but is preferably Z-folded. A Z-folded configuration enables a folded stack of wipes to be interleaved with overlapping portions. The lightweight wipe may be packaged in various convenient forms, whereby the method of packaging is not meant to be a limitation of the present invention.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method for making a durable lightweight nonwoven imaged wipe in an in-line process at production speeds of at least 150 meters per minute comprising the steps of:

a. providing a fibrous matrix;

b. providing a cross-lapper;

c. providing a foraminous imaging surface;

d. carding said fibrous matrix into a nonwoven web;

e. imparting a single transverse fold into said web with said cross-lapper;

f. pre-hydroentangling said nonwoven web;

g. advancing said web onto said foraminous imaging surface so as to impart a three-dimensional image or pattern into said web forming said imaged wipe, wherein said imaged wipe has a basis weight less than or equal to 2.0 ounces per square yard and a CD to MD elongation ratio of at least 3:1.

2. A method for making a durable lightweight nonwoven imaged wipe in an in-line process at production speeds of at least 150 meters per minute in accordance with claim 1, wherein said foraminous imaging surface is a three-dimensional image transfer device.

* * * * *